US005228691A

United States Patent [19]

McAlley

[11] Patent Number: 5,228,691

[45] Date of Patent: Jul. 20, 1993

[54] BASKETBALL GAME APPARATUS

[76] Inventor: Brian M. McAlley, 230 Pelham Rd., New Rochelle, N.Y. 10805

[21] Appl. No.: 993,371

[22] Filed: Dec. 18, 1992

[51] Int. Cl.[5] ..... A63F 7/20

[52] U.S. Cl. ..... 273/85 R; 273/396

[58] Field of Search ..... 273/1.5 R, 85 R, 85 H, 273/394, 396, 397

[56] References Cited

U.S. PATENT DOCUMENTS

| | | | |
|---|---|---|---|
| 943,478 | 12/1909 | Schreiber et al. | 273/85 H |
| 1,313,484 | 8/1919 | Hendron | 273/397 |
| 2,404,652 | 7/1946 | Plebanek | 273/397 X |
| 2,611,615 | 9/1952 | Watson et al. | 273/85 R |
| 2,658,495 | 11/1953 | Elliott, Sr. | 273/1.5 R X |
| 2,824,739 | 2/1958 | Frank | 273/85 R X |
| 2,893,734 | 7/1959 | Tarte, Jr. | 273/85 R |
| 3,092,387 | 6/1963 | Wagner | 273/85 R |
| 3,368,814 | 2/1968 | Kolwicz | 273/396 X |
| 3,592,470 | 7/1971 | Breslow | 273/1.5 R X |
| 3,761,089 | 9/1973 | Slane | 273/1.5 R X |

FOREIGN PATENT DOCUMENTS

| | | | |
|---|---|---|---|
| 2228513 | 12/1974 | France | 273/396 |

*Primary Examiner*—Paul E. Shapiro
*Attorney, Agent, or Firm*—Leon Gilden

[57] ABSTRACT

A basketball game includes a housing having a basketball net member mounted to a second end wall extension, wherein a first conduit projects a ball relative to the extension for projection through an associated basketball hoop and to be received in one of a plurality of openings through a receptacle plate below the basketball hoop, with the openings arranged for providing varying points relative to one another and subsequent directing a game ball from the receptacle plate through an exit port.

4 Claims, 4 Drawing Sheets

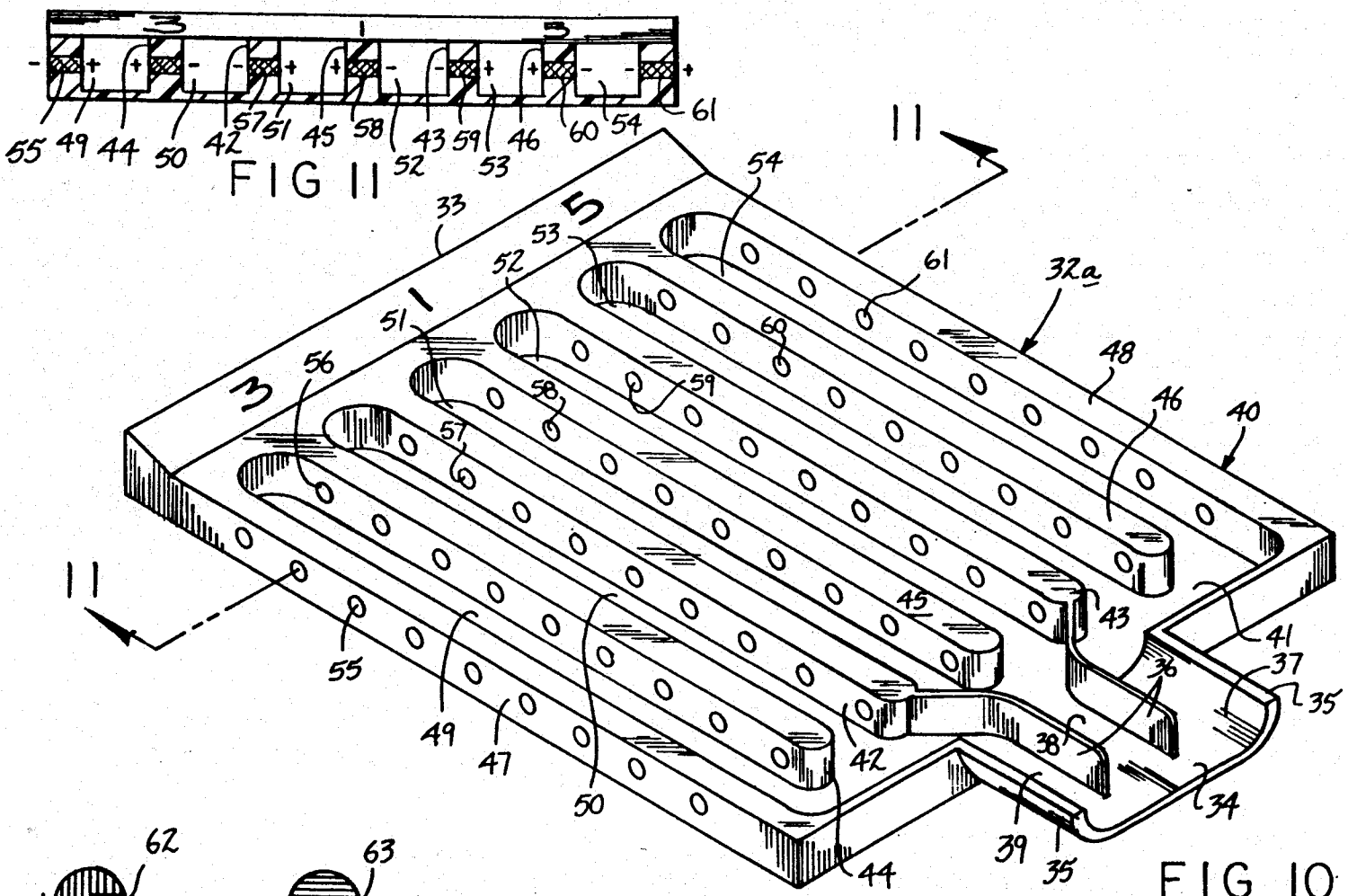
FIG 10
FIG 11
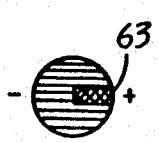
FIG 9
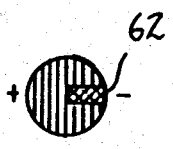
FIG 8

BASKETBALL GAME APPARATUS

BACKGROUND OF THE INVENTION

1. Field of the Invention

The field of invention relates to game apparatus, and more particularly pertains to a new and improved basketball game apparatus arranged for the awarding of points relative to the projection of a basketball through a basketball hoop.

2. Description of the Prior Art

Game apparatus of various types have been utilized throughout the prior art for entertainment and amusement of individuals. Such game apparatus is exemplified in the U.S. Pat. Nos. 5,060,940; 4,720,101; 4,896,882; and 4,579,339.

The instant invention attempts to overcome deficiencies of the prior art by providing for a game to readily simulate basketball play and directing the basketballs from an associated hoop through one of a plurality of associated designated openings below the hoop.

SUMMARY OF THE INVENTION

In view of the foregoing disadvantages inherent in the known types of basketball game apparatus now present in the prior art, the present invention provides a basketball game apparatus wherein the same is arranged for the projection of a basketball game ball through a hoop for reception within one of a plurality of designated apertures below the hoop. As such, the general purpose of the present invention, which will be described subsequently in greater detail, is to provide a new and improved basketball game apparatus which has all the advantages of the prior art basketball game apparatus and none of the disadvantages.

To attain this, the present invention provides a basketball game including a housing having a basketball net member mounted to a second end wall extension, wherein a first conduit projects a ball relative to the extension for projection through an associated basketball hoop and to be received in one of a plurality of openings through a receptacle plate below the basketball hoop, with the openings arranged for providing varying points relative to one another and subsequent directing a gate ball from the receptacle plate through an exit port.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither Intended to define the invention of the application, which is measured by the claims, nor is it intended to be limiting as to the scope of the invention in any way.

It is therefore an object of the present invention to provide a new and improved basketball game apparatus which has all the advantages of the prior art basketball game apparatus and none of the disadvantages.

It is another object of the present invention to provide a new and improved basketball game apparatus which may be easily and efficiently manufactured and marketed.

It is a further object of the present invention to provide a new and improved basketball game apparatus which is of a durable and reliable construction.

An even further object of the present invention is to provide a new and improved basketball game apparatus which is susceptible of a low cost of manufacture with regard to both materials and labor, and which accordingly is then susceptible of low prices of sale to the consuming public, thereby making such basketball game apparatus economically available to the buying public.

Still yet another object of the present invention is to provide a new and improved basketball game apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 8 is an orthographic view, taken along the lines 8—8 of FIG. 6 in the direction indicated by the arrows.

FIG. 9 is an orthographic view, taken along the lines 9—9 of FIG. 7 in the direction indicated by the arrows.

FIG. 10 is an isometric illustration of a modified receiving tray structure employed in association with the modified receptacle housing, as indicated in FIG. 5.

FIG. 11 is an orthographic view, taken along the lines 11—11 of FIG. 10 in the direction indicated by the arrows.

DESCRIPTION OF THE PREFERRED EMBODIMENT

Figure 1:
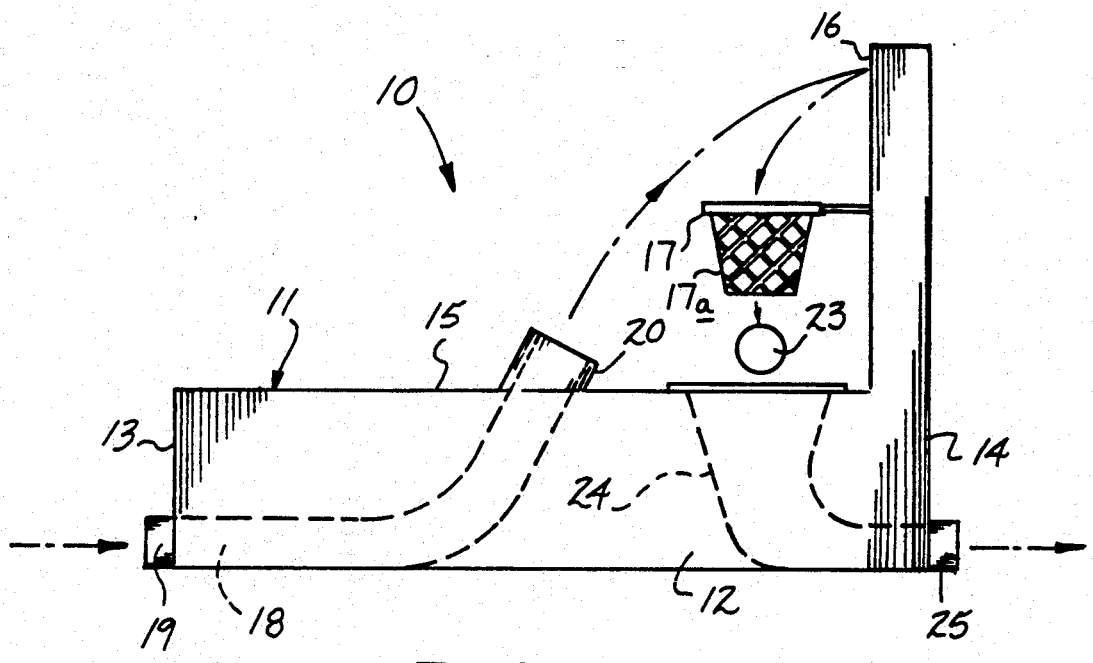
FIG. 1 is an orthographic side view of the invention.
Figure 2:
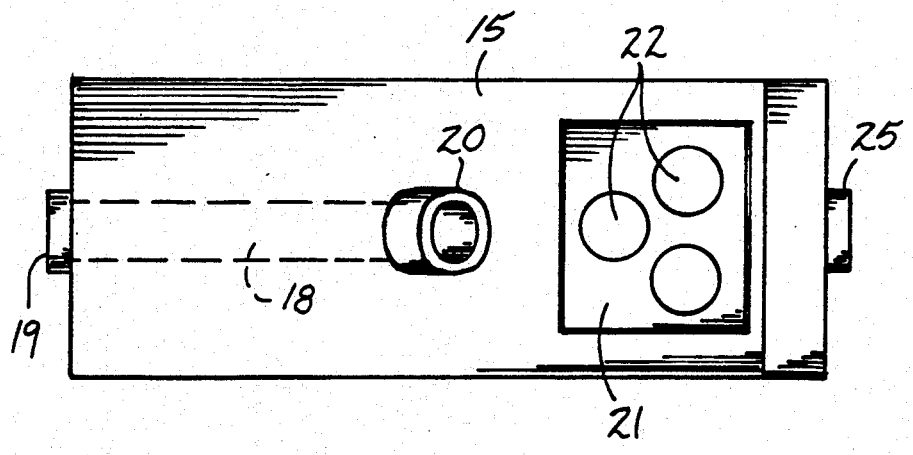
FIG. 2 is an orthographic view of the invention indicating the receiving openings relative to a receptacle plate below the basketball hoop.

With reference now to the drawings, and in particular to FIGS. 1 to 11 thereof, a new and improved basketball game apparatus embodying the principles and concepts of the present invention and generally designated by the reference numeral 10 will be described.

More specifically, the basketball game apparatus 10 of the invention includes a primary housing 11, having side walls 12, a first end wall 13 of a first height spaced from a second end wall 14 of a second height greater than the first height, with the second wall 14 extending beyond a top wall 15, as illustrated. A second end wall extension plate 16 coextensive with the second end wall 14 includes a basketball hoop 17 mounted thereto positioned over the top wall 15, with a hoop 17 having a flexible net 17*a* of a generally truncated conical configuration extending therefrom. An entry conduit 18 includes an entry conduit entrance port 19 directed through the first end wall 13 in adjacency to a lower distal end thereof to receive a game ball 23 that is rolled and received into the entry conduit 18 through the entrance port 19. An entry conduit exit port 20 in communication with the entry conduit 18 is arranged at an acute included angle relative to the top wall 15 between the exit port 20 and the extension plate 16, with the exit port 20 arranged to extend and orient above and medially of the basketball hoop 17. Dependent upon velocity and whether the game ball is deflected from the extension plate 16 or merely is deposited into the hoop 17 from the entry conduit exit port 20, the game ball will be deposited upon an underlying receptacle plate 21 (see FIGS. 2 and 3 for example) that is oriented below the basketball flexible net 17*a* and received through one of a plurality of receptacle plate apertures 22. The receptacle plate 21 is substantially parallel relative to the top wall 15, wherein the game ball 23 is arranged to exit through an exit conduit exit port 25 directed through the second end wall 13 below the top wall 15.

Figure 3:
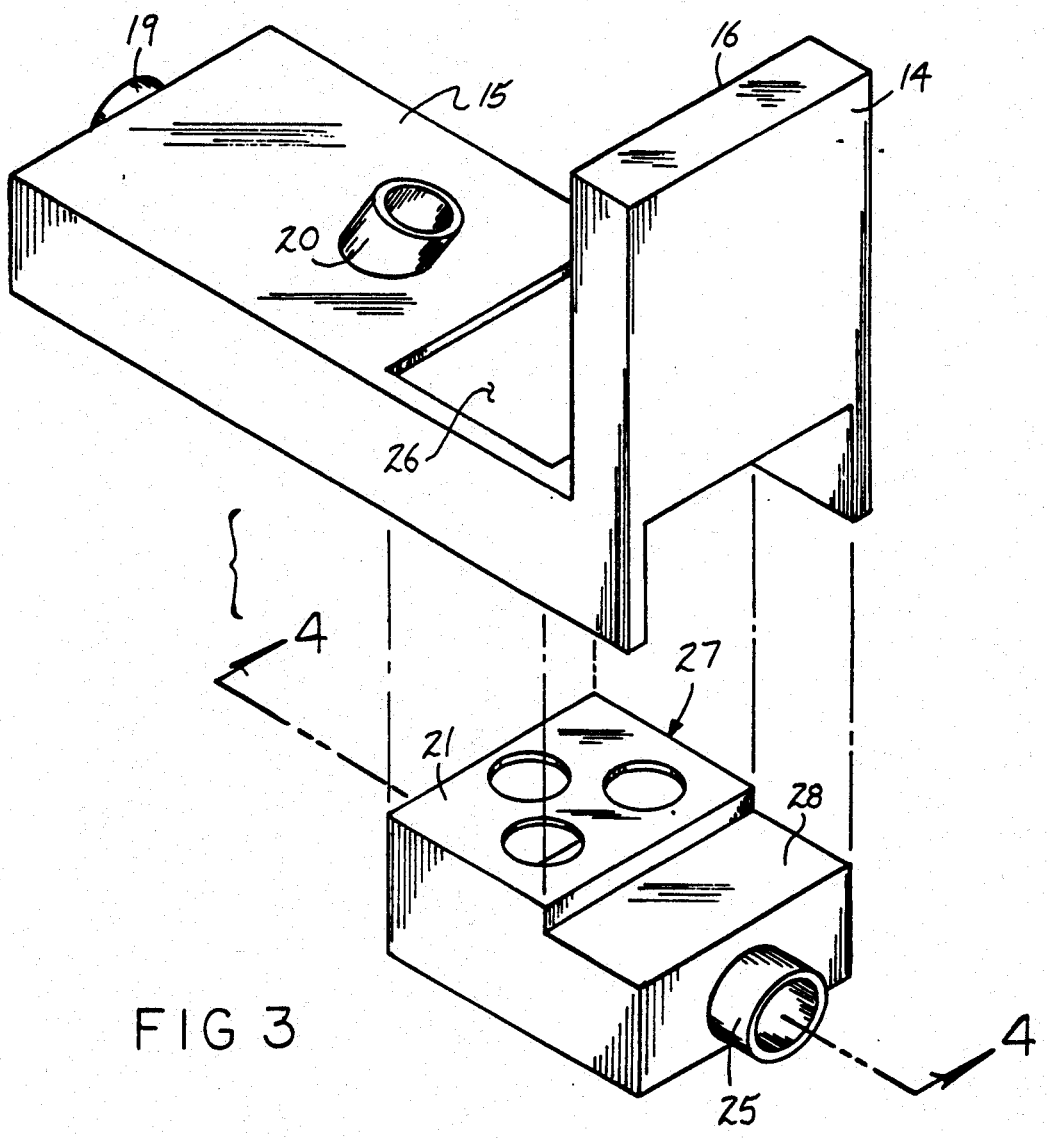
FIG. 3 is an isometric view of the invention, somewhat exploded, to indicate the receptacle housing removably mounted relative to the primary housing.
Figure 4:
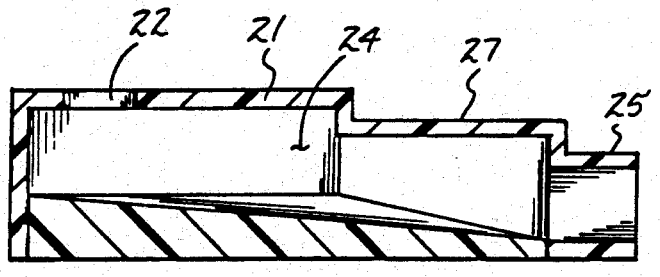
FIG. 4 is an orthographic view, taken along the lines 4—4 of FIG. 3 in the direction indicated by the arrows.
Figure 5:
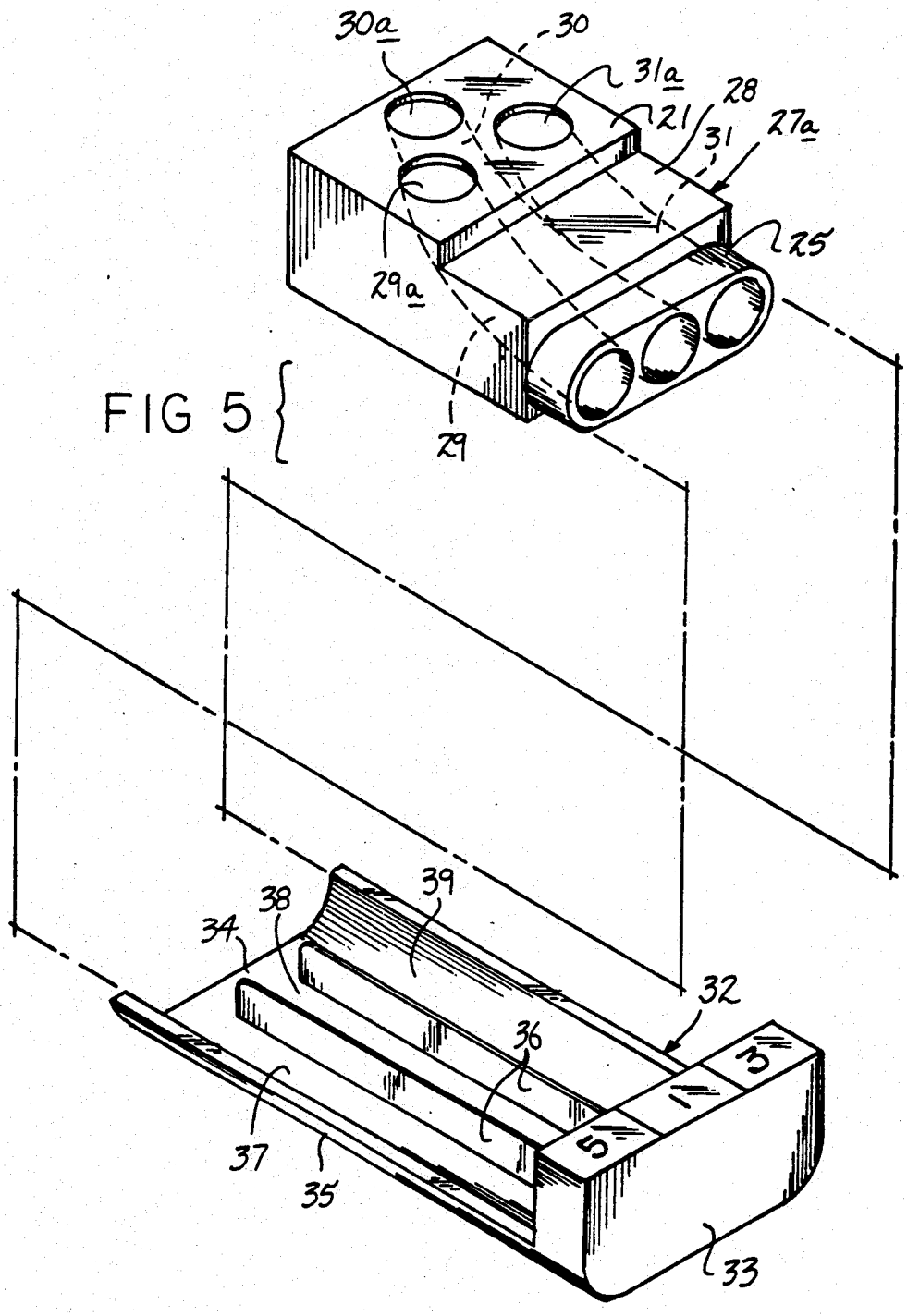
FIG. 5 is an isometric illustration of a modified receptacle housing structure employed by the invention.

Reference to FIG. 3 indicates the receptacle plate 21 formed integrally to a receptacle housing 27, wherein the receptacle plate accordingly is received complementarily through a housing top wall opening 26 directed through the top wall 15. The receptacle housing has an abutment wall 28 parallel to and spaced from the receptacle plate for abutment with the top wall 15 between the top wall 15 and the first end wall 14. The modified receptacle housing 27*a*, as indicated in FIG. 5, includes first, second, and third conduits 29, 30, and 31 associated with respective first, second, and third receptacle plate apertures 29*a*, 30*a*, and 31*a* respectively. The first, second, and third conduits are accordingly directed through the exit conduit's exit port 25 that in turn receives a receiving tray 32. The receiving tray 32 includes a receiving tray bottom wall 34 positioned below the exit conduit's exit port, with receiving tray side walls 35 extending above the bottom wall 34, with a receiving tray end wall 33 forming an abutment. A plurality of parallel divider plates 36 oriented parallel to the side walls 35 define respective first, second, and third chutes 37, 38, and 39 respectively, with the chutes respectively aligned with one of the conduits 29–31. More specifically, the first, second, and third conduits 29, 30, and 31 are respectively aligned with the respective first, second, and third chutes 37, 38, and 39, with each chute awarded a point, as indicated on the receiving tray end wall 33, to award a point total relative to a game ball being directed into one of the chutes.

Figure 6:
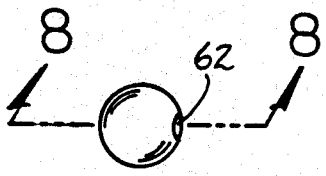
FIG. 6 is an isometric illustration of a modified game ball structure.
Figure 7:
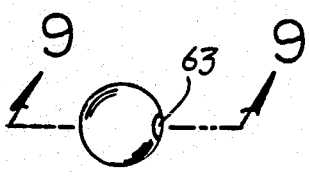
FIG. 7 Is a further modified aspect of the game ball structure.

The game ball structure, as indicated in FIGS. 6 and 7, are provided and include first and second polarity of game ball magnet faces 62 and 63 arranged in a coextensive relationship relative to the spherical exterior surface of the associated game balls, as illustrated in FIGS. 6 and 7, and respectively 8 and 9. The game balls are arranged for reception with the modified receiving tray structure 32*a*, as illustrated in FIG. 10. The receiving tray 32 is arranged in cooperation with a receptacle container 40, having a container floor 41 coplanar with the receiving tray floor or bottom wall 34, with container first and second divider walls 42 and 43 arranged in integral communication with one of the divider plates 36 to provide for a trio of receiving paths, wherein the first receiving path includes first and second runways 49 and 50, a second receiving path having third and fourth runways 51 and 52, and a third receiving path including runways 53 and 54. The runways are separated by respective first, second, and third intermediate walls 44, 45, and 46, with the container 40 having container first and second side walls 47 and 48 positioned in parallel relationship relative to respective first and third intermediate walls 44 and 46 respectively. The side walls include respective first and seventh magnets 55 and 61, with the divider walls 42 and 43 having third and fifth magnets 57 and 59, and the intermediate walls 44, 45, and 46 having respective second, fourth, and sixth magnets 56, 58, and 60 respectively. The magnets are arranged for projection into the runways from the wall structure to provide for opposing like polarities in the first runway 49. Similarly, like negative polarities are within and projecting into the second runway 50, like positive polarities directed into the third runway 51, like negative polarities directed into the fourth runway 52, like positive polarities directed into the fifth runway 53, and like negative polarities directed into the sixth runway 54. In this manner, when a respective negative or positive projecting first and second polarity game ball magnet face 62 and 63 is directed within the runways, the magnets will tend to rotate and displace when a first polarity game ball magnet face 62 of a negative polarity is directed into the first, third, and fifth runways, while the positive polarity of the second polarity game ball magnet face 63 will tend to deflect when directed into the second, fourth, and sixth runways for enhanced entertainment and amusement of individuals.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A basketball game apparatus, comprising, a primary housing having spaced housing side walls, a housing first end wall, and a housing second end wall spaced from the housing first end wall, and a top wall, the housing first end wall having a first height, the housing second end wall having a second height greater than the first height, with a second end wall extension plate extending from the top wall in adjacency to the second end wall, with the second end wall extension plate projecting above the top wall, and a basketball hoop mounted to the second end wall extension plate, with a flexible net mounted to the basketball hoop, and an entry conduit directed into the housing, with the entry conduit having an entry conduit entrance port extending through the housing first end wall, and the entry conduit having an entry conduit exit port directed through the housing top wall, with the entry conduit exit port defining an acute included angle between the entry conduit exit port and the top wall and canted towards the basketball hoop, and a game ball arranged for projection through the entry conduit directed towards the basketball hoop.

2. An apparatus as set forth in claim 1 including a housing top wall opening positioned below the basketball hoop, and a receptacle housing, with the receptacle housing mounted within the primary housing, with the receptacle housing having a receptacle plate complementarily received through the housing top wall opening in a parallel relationship relative to the top wall, and the receptacle housing having an abutment wall in a spaced relationship in adjacency to the receptacle plate arranged in engaged abutment with the top wall between the housing top wall opening and the housing second end wall, with the receptacle plate having a plurality of receptacle plate apertures directed therethrough, and at least one of the apertures arranged in communication with conduit means that is directed through the receptacle housing, and the conduit means arranged for projection through the housing second end wall to direct the game ball from the basketball hoop through one of the receptacle plate apertures and the conduit means.

3. An apparatus as set forth in claim 2 wherein the plurality of apertures includes a first aperture, a second aperture, and a third aperture, and the conduit means includes a first conduit in communication with the first aperture, a second conduit in communication with the second aperture, and a third conduit in communication with the third aperture, and the first conduit, the second conduit, and the third conduit directed through the housing second end wall.

4. An apparatus as set forth in claim 3 including a receiving tray, the receiving tray having a receiving tray bottom wall receiving the first conduit, the second conduit, and the third conduit thereon, and receiving tray side walls mounted to the receiving tray bottom wall extending above the receiving tray bottom wall to confine the first conduit, the second conduit, and third conduit onto the receiving tray bottom wall, and the receiving tray further having a receiving tray end wall spaced from the primary housing second end wall, and the receiving tray end wall fixedly mounted to the receiving tray bottom wall between the receiving tray side walls, and a plurality of parallel divider plates fixedly mounted to the receiving tray bottom wall between the receiving tray side walls, with a first chute oriented between one of the receiving tray side walls and one of the divider plates, with the first chute aligned with the first conduit, and a second chute oriented between the divider walls in alignment with the second conduit, and a third chute aligned with the third conduit oriented between one of the divider walls and one of the side walls.

* * * * *